United States Patent [19]

Gehrie et al.

[11] 3,961,505

[45] June 8, 1976

[54] LATCHING DEVICE INCLUDING COMBINATION LOCKING MEANS

[75] Inventors: Charles S. Gehrie, Montclair; Lazlo Bako, Woodcliff Lake, both of N.J.

[73] Assignee: Presto Lock Company, Elmwood Park, N.J.

[22] Filed: Nov. 5, 1974

[21] Appl. No.: 521,040

[52] U.S. Cl. ..... 70/66; 70/71; 70/312

[51] Int. Cl.[2] ..... E05B 65/52

[58] Field of Search ..... 70/63, 64, 66, 67, 69, 70/70, 71, 287, 312, 465

[56] References Cited

UNITED STATES PATENTS

| | | | |
|---|---|---|---|
| 1,920,189 | 8/1933 | Dorst et al. | 70/66 |
| 2,242,550 | 5/1941 | Schell | 70/66 |
| 3,800,571 | 4/1974 | Heine | 70/71 |

*Primary Examiner*—Richard E. Moore
*Attorney, Agent, or Firm*—Shapiro and Shapiro

[57] ABSTRACT

In a latching device cooperable with a pair of spaced hasps, a pair of spaced latch mechanisms which are biased toward unlatching condition are held in latching condition by respective longitudinally movable control members. A manually rotatable control knob located intermediate the latch mechanisms and cooperable with the control members is movable to a release position which permits the latch mechanisms to be urged into unlatching condition, the latch mechanisms being returnable manually to latching condition. Combination locking means is provided for releasably locking the latch mechanisms in latching condition.

15 Claims, 19 Drawing Figures

LATCHING DEVICE INCLUDING COMBINATION LOCKING MEANS

The invention relates to latching devices for containers or receptacles having separable sections to be releasably secured together in closed position, and is more particularly directed to an improved latching device for luggage cases which is cooperable with a pair of spaced hasps and which employs combination locking means of the multiple dial type for releasably locking the luggage case sections together.

BACKGROUND OF THE INVENTION

In latching devices for cases, such as luggage cases, it is generally known to employ a pair of latch members near opposite corners of one case section for cooperation with respective spaced hasps or keepers mounted on the other case section and to remotely control the latch members by manually operable control means located intermediate the two latch members.

U.S. Pat. No. 3,555,860 to Atkinson, for example, discloses a luggage case latching device which includes a pair of overlapping, longitudinally movable slide plates each having a slide rod connected thereto, the outer end of each rod being formed as a latch hook for engaging a respective keeper. Each slide rod has a push button associated therewith. Movement of the push buttons inwardly toward each other with the luggage case closed moves the slide rods into latching position in which the latch hooks engage their respective hasps, whereas, movement of the push buttons outwardly away from each other releases the keepers to enable opening of the luggage case. The inner ends of the two slide plates have notches which are disposed in overlapping alignment when the slide rods are in latching position. When the multiple dials of a centrally located combination lock are off combination, these notches receive a projection on a tiltable fence member, thereby releasably locking the slide rods in latching position.

The Atkinson device has several limitations. To latch together the cooperable sections of a luggage case employing the device, it is necessary to move the two push buttons inwardly toward each other while simultaneously holding the cooperable luggage case sections together. In accordance with common practice, during closing of the luggage case the user may place both hands on the case near opposite corners thereof so that the luggage case sections can be drawn together by the force exerted between the palm and fingers of each hand. In fact, if the luggage case is overpacked, this may be the only satisfactory method of applying the considerable force required to hold the luggage case sections together. However, when the luggage case sections are being held together by both hands, inward movement of the push buttons (for example, by thumb pressure) is awkward for the user. Furthermore, when the case is overpacked to such an extent that it is difficult to hold the luggage case sections together, the luggage case sections cannot be drawn together even a small amount by operation of the latching device, because the latch hooks and associated keepers are not formed for drawing engagememt. Even if the latch hooks and keepers were so formed, the construction of the Atkinson device would not enable the user to apply to the push buttons the substantial inward pressure required to draw the luggage case sections together while simultaneously forcing the luggage case sections together by the force of both hands.

SUMMARY OF THE INVENTION

It is accordingly an object of the invention to provide, for use on luggage cases or the like, an improved latching device which is cooperable with a pair of spaced hasps and which can be conveniently changed from unlatching to latching condition, even when both hands are employed to hold the cooperable luggage case sections together.

A latching device in accordance with the invention for engaging a pair of spaced hasps comprises a pair of latch mechanisms cooperable with respective hasps and each having latching and unlatching conditions, biasing means for urging the latch mechanisms into unlatching condition, and manually operable control means located intermediate the latch mechanisms and movable to first and second positions. The control means is cooperable with both the latch mechanisms to maintain the latch mechanisms in latching condition when the control means is in the first position and to permit the biasing means to change the latch mechanisms from latching to unlatching condition when the control means is moved to the second position.

In the preferred embodiment, each latch mechanism includes a longitudinally movable plug member which is formed to engage a respective hasp and which is spring-biased into engagement with an associated pivotally-mounted latch member. The control means preferably includes a manually operable actuating member, such as a rotatable knob or lever, the actuating member being cooperable with the inner ends of a pair of control members for moving the control members longitudinally in opposite directions when the lever is rotated between latching and release positions. The outer ends of the control members are engageable with respective latch members for holding the latch members in lowered position when the control lever is in the latching position, which causes the plug members to engage their associated hasps. When the lever is rotated to the release position, the control members are moved out of engagement with the latch members, thereby enabling the spring-biased plug members to move the latch members to raised position as the plug members move out of engagement with the hasps. A tiltable fence member in a multiple dial-type combination lock is cooperable with one of the control members for preventing rotation of the control lever to the release position when the lock is off combination.

The above-described objects and advantages of the invention as well as other advantages and improved results will be apparent from the following detailed description of the invention.

DESCRIPTION OF THE PREFERRED EMBODIMENT

Figure 1:
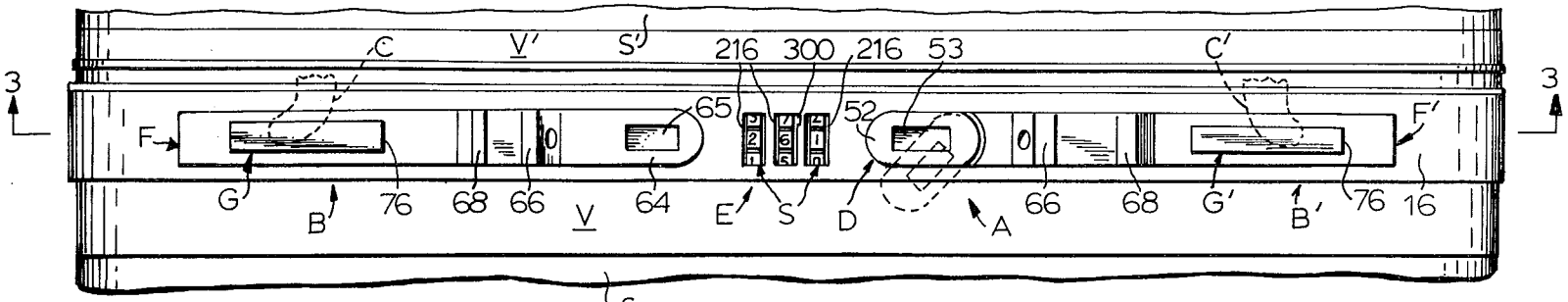
FIG. 1 is a top plan view of a latching device in accordance with the invention mounted on one of the cooperable sections of a luggage case and cooperable with a pair of hasps provided by the other luggage case section, this view showing the latching and release positions of the rotatable control lever in solid lines and dotted lines, respectively, and showing the latching device in latching condition.
Figure 2A:
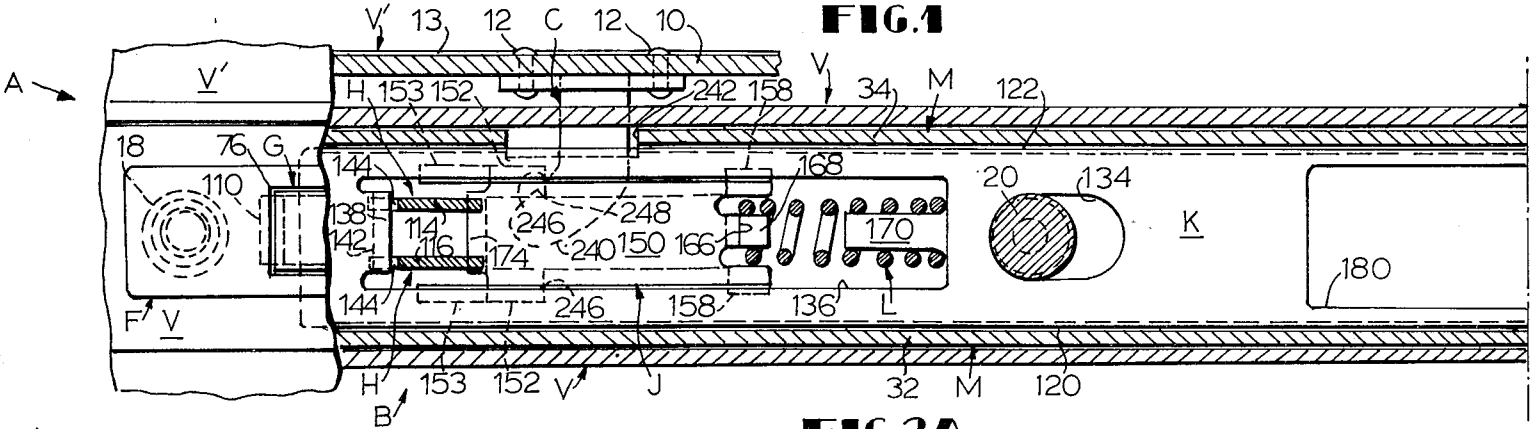
FIGS. 2A and 2B together form an enlarged top plan view of the latching device of FIG. 1 with certain of the parts broken away and in cross-section, this view showing the relationship of the parts for latching condition.
Figure 7:
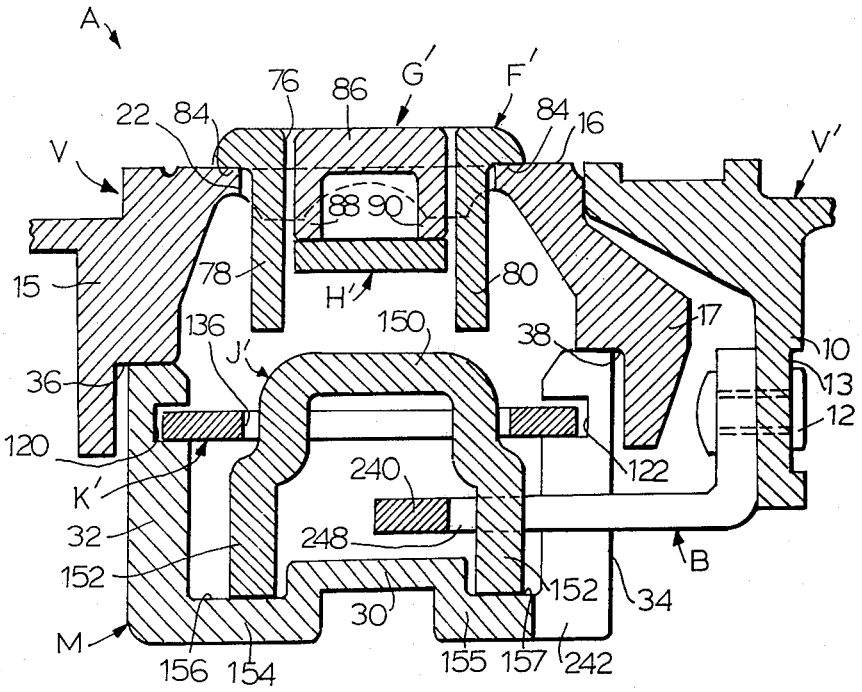
FIG. 7 is an enlarged, transverse cross-sectional view taken approximately in the plane of line 7—7 of FIG. 3B.

Referring to FIG. 1 of the drawings, a latching device A constructed in accordance with the invention is incorporated into a valance member V which is attached to the edge of luggage case section S by suitable means (not shown). The latching device essentially comprises a pair of longitudinally spaced left-hand and right-hand latch mechanisms B and B′ which are cooperable with hasps C and C′, respectively, provided by a cooperable valance member V′ which is suitably attached to the edge of the other luggage case section S′. In the illustrated form of the invention, the valance member V may be the male member and V′ may be the female member. It will be understood that the latching device may be incorporated in the female valance member. Referring to FIGS. 2A and 7, each hasp is secured to the vertical wall portion 10 of the female valance member by spaced headed-over rivets 12, the wall portion being provided with a longitudinal recess 13 for receiving one of the headed-over ends of each rivet.

As shown in FIG. 1, a manually operable actuating member D in the form of a rotatable control knob or lever D is provided just to the right of the center of valance member V intermediate the latch mechanisms for controlling the operation of the two latch mechanisms. Combination locking means E is provided at the center of the valance member for releasably locking the latching mechanisms in latching condition.

Figure 2B:
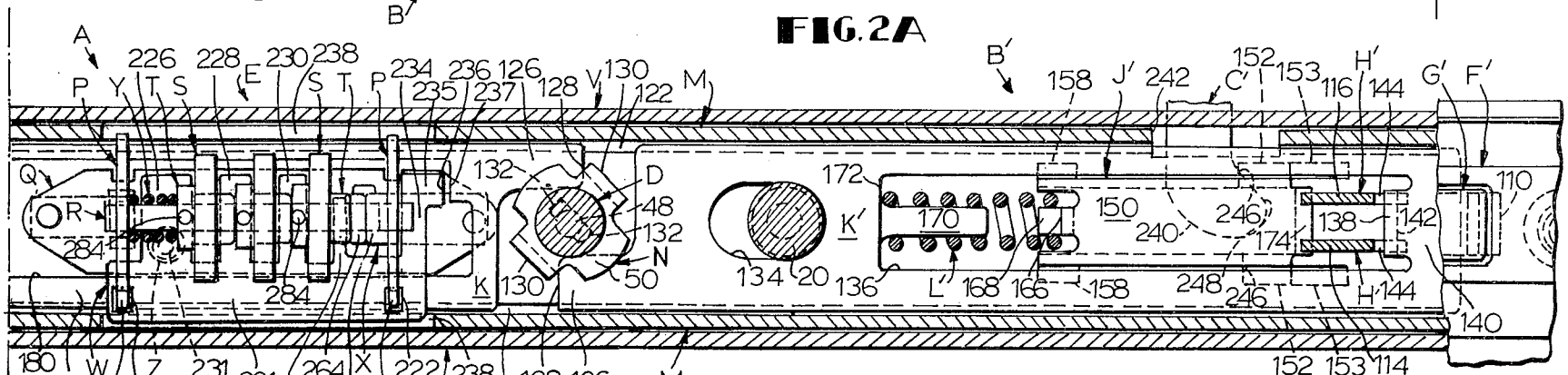
Figure 3A:
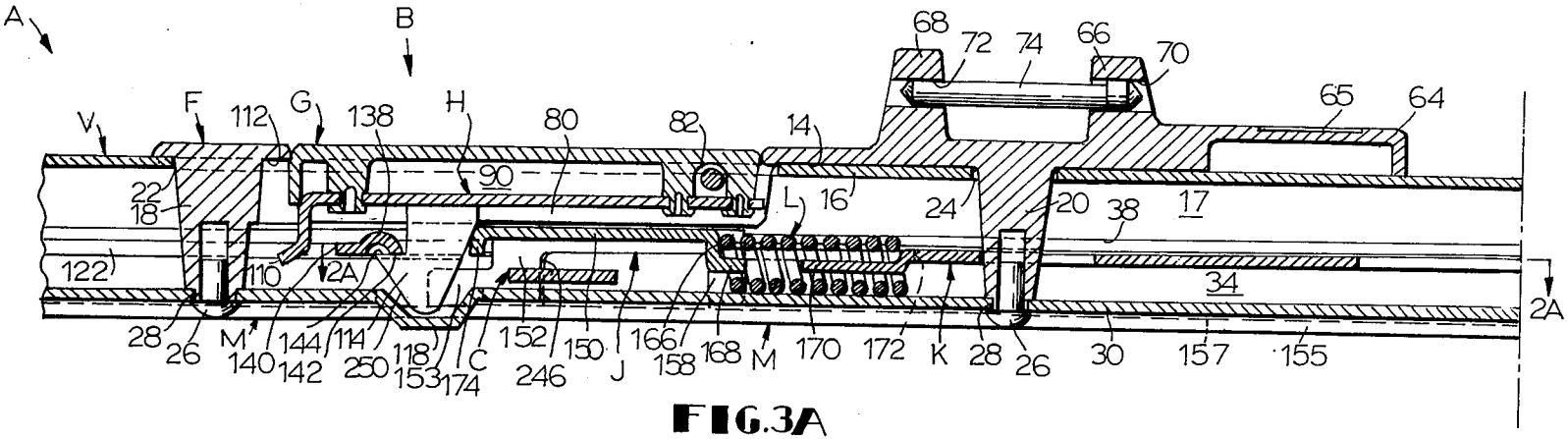
FIGS. 3A and 3B together form an enlarged longitudinal cross-sectional view taken approximately in the plane of line 3—3 of FIG. 1.
Figure 3B:
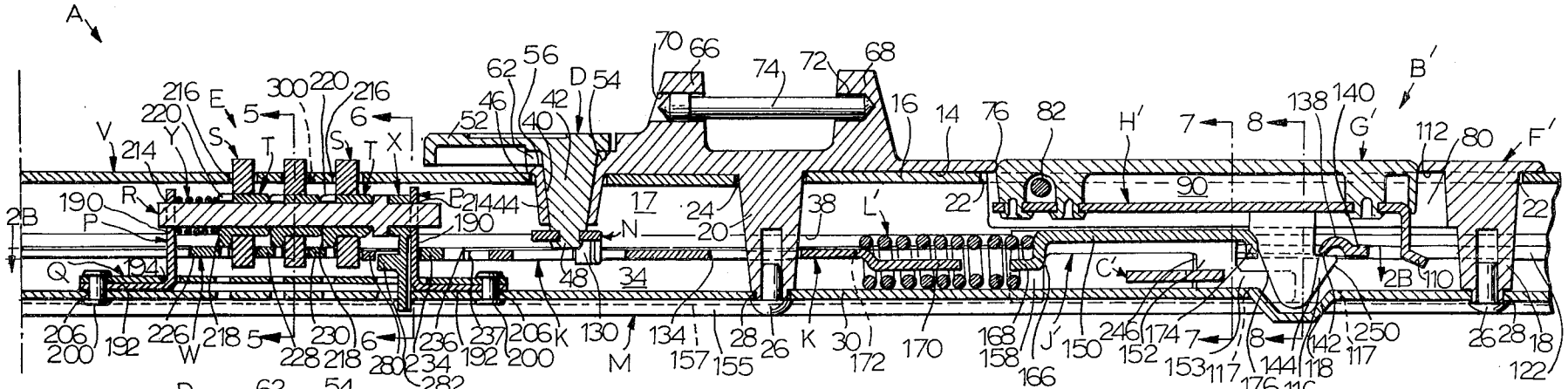

Referring to FIGS. 2A and 3A, the left-hand latch mechanism B includes a plate F, a pivotal latch member G having a hook H fixed thereto, a plug member J, a control member K, and a biasing spring L. For convenience of manufacture, the hook H is separately made and connected to the member G. If desired, these parts may be made as one piece. Together they constitute the latch member. The right-hand latch mechanism B′ includes identical elements which are designated by the same reference letters modified by primes, as shown in FIGS. 2B and 3B, corresponding parts of the elements in both latching mechanisms being designated by the same reference numerals. For convenience of manufacture, the puller, the plates, and the latch members are preferably made by die casting these parts.

Figure 8:
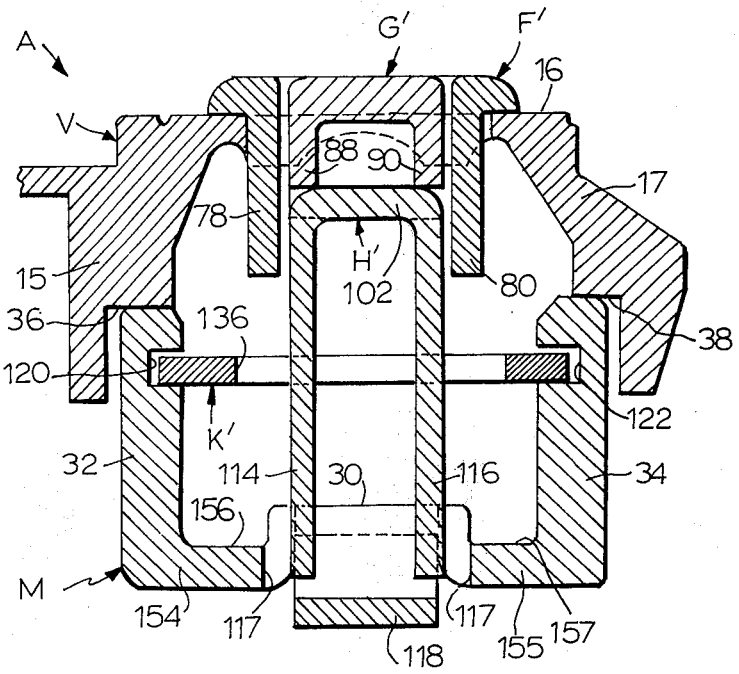
FIG. 8 is an enlarged, transverse cross-sectional view taken approximately in the plane of line 8—8 of FIG. 3B.

Referring to FIG. 3B, the planar bottom surface 14 of longitudinally extending plate F′ in right-hand latch mechanism B′ rests upon the raised planar central top wall portion 16 of valance member V (FIGS. 7 and 8), which also has transversely spaced side walls 15 and 17. Two hollow, tapered connecting studs 18 and 20 depend from bottom surface 14 of the plate for securing the plate to the valance member. Connecting stud 18 projects downwardly near the outer or right end of the plate through the outer end portion of a longitudinally extending rectangular slot 22 in the valance member. Connecting stud 20 projects downwardly from a point near the inner or left end of the plate and through a circular opening 24 in the valance member. The ends of the connecting studs have reduced diameter portions which are received in circular openings 28 in the raised central bottom wall portion 30 of a channel member M (see FIG. 7), which is preferably formed as an aluminum extrusion. Rivets 26 are forced into the ends of the studs to secure plate F′ against central portion 16 of male valance member V and to secure the end surfaces of the laterally spaced, longitudinally extending side walls 32 and 34 of the channel member M against recessed shoulders 36 and 38. respectively, of the valance member V, as shown in FIGS. 7 and 8.

Figure 3C:
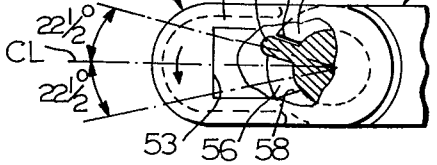
FIG. 3C is a partial top plan view of the control lever and associated plate of the latching device, with the lever and plate broken away and in cross-section to show rotation limiting means.

Referring again to FIG. 3B, the inner or left end of plate F′ has a downwardly tapering bore 40 receiving the conformingly tapered boss 42 of rotatable control lever D, the lower region of the bore being defined by a downwardly tapering hollow projection 44 which extends from the plate through a circular opening 46 in valance member V. A camming plate N is secured to the end of boss 42 of the control lever by a headed-over stud 48 and is cooperable with the end of projection 44 for rotatably securing the control lever D in the bore with the bottom surface of top wall 52 of the puller in sliding engagement with bearing surface 54 on plate F′. As shown in FIG. 3C, the bearing surface 54 of the plate is generally annular in shape with a portion cut away at 56 to provide vertical stop walls 58 and 60 which are cooperable with a radially extending lug 62 on the control lever for limiting rotational movement of the lever. When the lever is in the position shown in solid lines in FIG. 1 and shown in FIGS. 3B and 3C, projection 62 of the lever abuts stop wall 60 of the plate, as shown in FIG. 3C, for preventing clockwise movement of the lever. With the lever in this position (the latching position), lug 62 is angularly displaced by 22½ degrees clockwise from the centerline CL of the plate F′. The lever may be rotated counterclockwise (in the direction of the arrow on the lever) from the latching position until lug 62 on the lever is brought into engagement with stop wall 58 of plate F′, this position (the unlatching or release position) being shown in dotted lines in FIG. 1. In this position lug 62 will be angularly displaced counterclockwise from centerline CL by 22½ degrees so that a total rotational movement of 45° is provided for the lever. As shown in FIG. 1, the upper surface of top wall 52 of the lever may have a shallow rectangular recess 53 formed therein for the insertion of an initial.

Plate F of left-hand latch mechanism B is substantially identical to plate F′, the only difference being that instead of being shaped to support a rotatable lever, the inner end portion 64 of plate F (FIGS. 1 and 3A) is shaped to generally resemble lever D in the solid line position of FIG. 1. The top surface of the end portion is provided with a shallow rectangular recess 65 similar to recess 53 of the lever for the insertion of a second initial.

Returning to FIG. 3B, adjacent to control lever D on plate F′ are a pair of longitudinally spaced upstanding lugs 66 and 68 which provide the means for connecting the right end of a luggage case handle (not shown) to the luggage case. Lug 66 has a cylindrical bore 70 aligned with a cylindrical recess 72 in lug 68, the bore and the recess receiving opposite ends of a connecting pin 74 which is adapted to be inserted through a longitudinal opening in the end of the handle.

Plate F′ is further provided with a rectangular slot 76 (see FIGS. 1, 4B and 7) which extends longitudinally between lug 68 and connecting stud 18 at the outer end of the plate. Referring to FIG. 7, transversely spaced side walls 78 and 80 depend from the plate adjacent the longitudinal edges of slot 76 and extend longitudinally from the innermost edge of the slot to merge with connecting stud 18, the side walls and the connecting stud being received by slot 22 in male valance member V (FIG. 3B). A transverse pivot pin portion 82 (FIG. 3B) is formed integrally with and between side walls 78 and 80 of the plate near the inner ends thereof to provide pivotal support for latch member G′, as described in detail hereinafter. Referring to FIG. 7, the plate F′ is only slightly wider than slot 22 in valance member V, forming narrow shoulders 84 which rest upon central portion 16 of the valance member adjacent the edges of the slot.

Figure 4A:
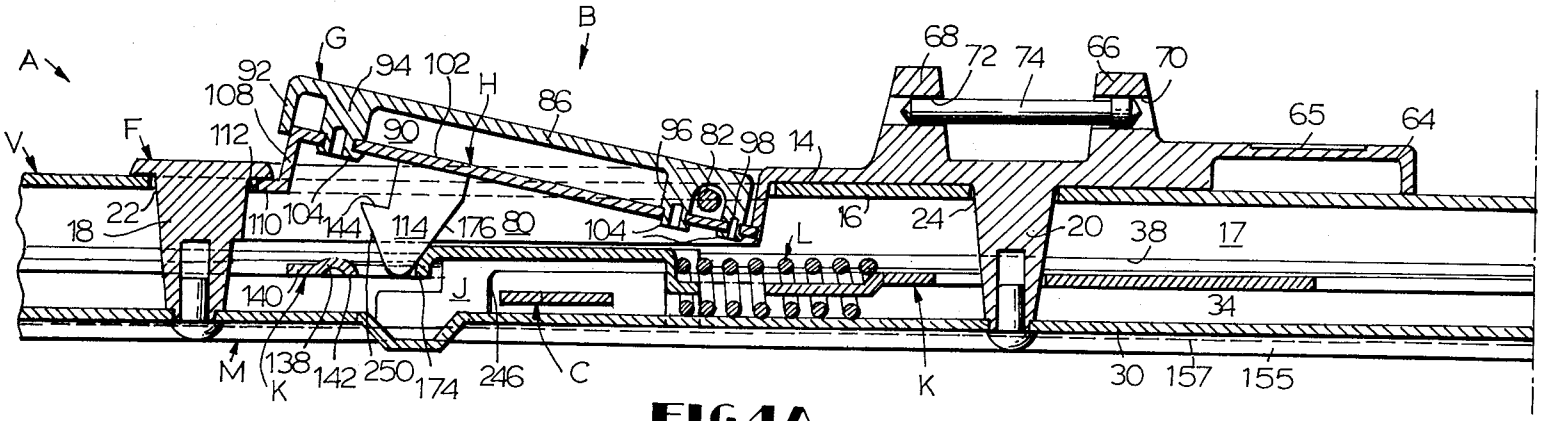
FIGS. 4A and 4B together form an enlarged longitudinal cross-sectional view similar to FIGS. 3A and 3B, but showing the relationship of parts for unlatching condition.
Figure 4B:
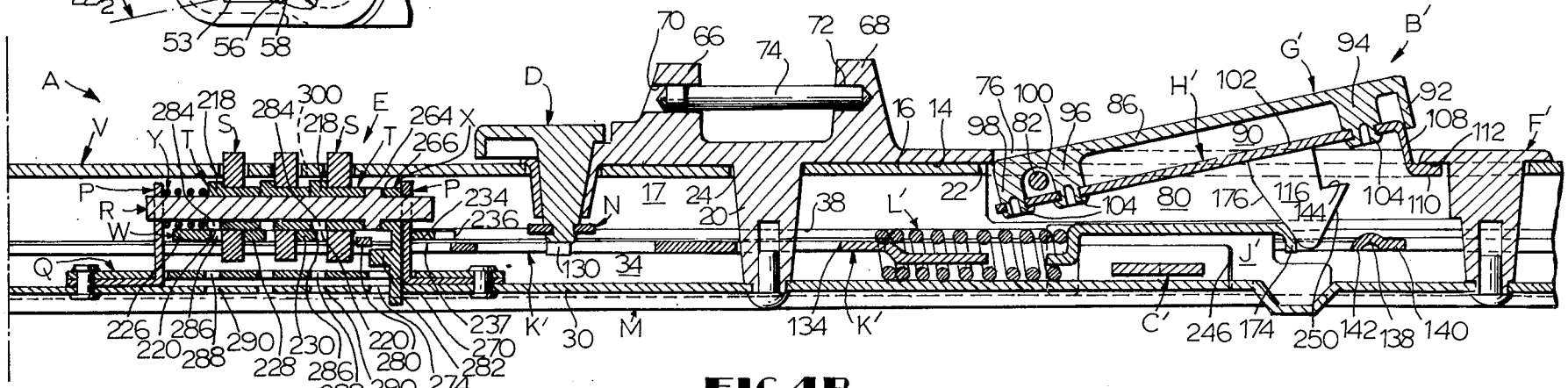
Figure 13:
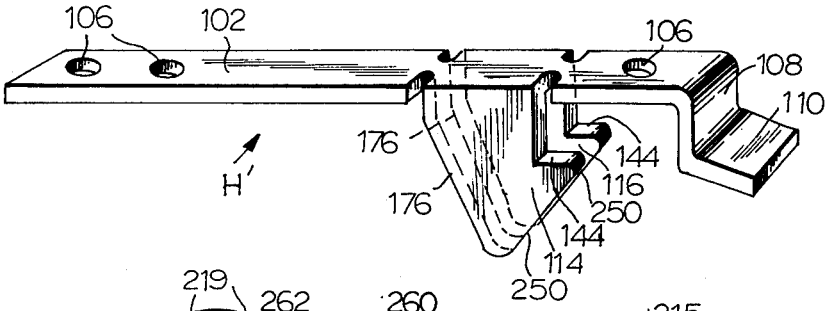
FIG. 13 is a perspective view of one of a pair of hooks employed in the latching device.

Latch member G′, which is rectangular in shape (see FIG. 1), has a planar top wall 86 (FIG. 4B), and has a pair of transversely spaced side walls 88 and 90 (FIG. 7) and a transverse outer end wall 92 (FIG. 4B) formed integrally with the top and side walls. As shown in FIG. 4B, also formed integrally with the top wall and side walls are transverse walls 94, 96 and 98 which are each thicker than the top wall. Wall 94 is closely adjacent outer end wall 92, while walls 96 and 98 are closely spaced at the other end of the latch member, forming a bearing recess 100 receiving pivot pin portion 82 of plate F′. The bearing recess is maintained in receiving engagement with pivot pin portion 82 by the rectangular top wall 102 of the hook member H′ (FIG. 13), the hook member being secured to the latch member by studs 104 which project from transverse walls 94, 96 and 98 of the latch member through respective openings 106 (FIG. 13) in top wall 102 and are headed-over. The top wall 102 of the latch member is bent downwardly perpendicularly from the top wall at 108 and is then bent outwardly at somewhat less than ninety degrees to provide a projection 110 which is cooperable with the bottom surface of plate F′ at 112 (see FIG. 4B) to limit upward rotational movement of the latch member to the position shown. Referring to FIG. 13, hook member H′ has a pair of transversely spaced, hook-shaped side walls 114 and 116 which are cooperable with plug member J′ and control member K′ in a manner to be described. Referring to FIG. 8, the longitudinal edge portions of a short section of raised central portion 30 of channel member M are cut away at 117 and the remaining part of portion 30 is bent downwardly at 118 to provide clearance for the side walls of the hook member, as shown in FIG. 3B.

Referring to FIG. 2B, right-hand control member K′ comprises a thin (0.046 inch, for example), generally rectangular steel plate which is supported for sliding longitudinal movement below plate F′ by channel member M. As shown in FIG. 7, the longitudinal edges of the control member are received in respective channels 120 and 122 which are formed in the side walls 32 and 34, respectively, of the channel member along the entire length thereof.

A relatively narrow longitudinal extension 126 projects from the inner end of the control member adjacent to one side thereof, as shown in FIG. 2B. As will be described more fully hereinafter, end surface 128 of this extension is engageable by the respective one of a pair of diametrically opposed, down-turned lugs 130 provided by camming plate N on lever D for moving the control member rightwardly from the position of FIG. 2B against the force of coil spring L′ when the lever is rotated counterclockwise from the solid line position of FIG. 1 to the dotted line position of FIG. 1. Referring to FIG. 2B, lugs 132 project axially from the end of the lever on opposite sides of headed-over stud 48 and are received by respective openings in top wall 50 of the camming plate for preventing rotation of the camming plate relative to the lever. Connecting stud 20 of the plate F′ projects through an opening 134 in the control member, the opening being longitudinally elongated to permit sliding movement of the control member.

Referring to FIG. 2B, the control member K′ has a generally rectangular opening 136 therein between opening 134 and the outer end of the control member. A flange or tongue 138 projects a short distance into opening 136 from the transversely narrow outer end portion 140 of the control member. Referring to FIG. 4B, the flange is cup-shaped in vertical cross-section with its concave side facing downwardly, the end of the flange providing a downwardly facing planar surface 142. When the control member is in the longitudinal position shown in FIG. 3B, surface 142 of the member engages the upwardly facing surfaces 144 on hook-shaped side walls 114 and 116 of hook member H′ (FIGS. 2B) to secure latch member G′ in lowered position, as shown.

Figure 9:
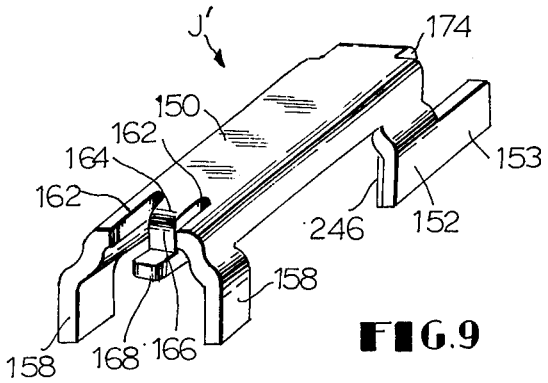
FIG. 9 is a perspective view of one of a pair of plug members employed in the latching device.

Plug member J′, which is formed to engage hasp C′, is supported for longitudinal movement by channel member M. Referring to FIGS. 1, 7 and 9, top wall 150 of the plug member has a transverse cross-section in the shape of an inverted U. A first pair of legs 152 depend from the outer end of top wall 150 and spread outwardly from the top wall before extending downwardly in parallel to engage respective bottom wall portions 154 and 155 of channel member M, as shown in FIG. 7. These bottom wall portions are cooperable with raised bottom wall portion 30 and side walls 32 and 34 to form transversely spaced longitudinal channels 156 and 157, respectively, for receiving the legs of the plug member. Referring to FIGS. 2B and 9, another pair of transversely spaced legs or feet 158 depend from the inner end of top wall 150. These legs have the same vertical cross-sectional configuration as legs 152 (FIG. 7) and also have their ends received in channels 154 and 156. As shown in FIG. 7, the top wall of the plug member projects through slot 136 in the control member. Referring to FIGS. 2B, 3B and 9, the lower portion of each of legs 152 extends longitudinally outwardly from the plug member at 153 to provide those legs with substantial surface areas in sliding contact with the bottom surfaces of channels 154 and 156. The longitudinal edges of raised bottom wall portion 30 of channel member M are cooperable with legs 152 and 158 of the plug members for guiding longitudinal movement of those members.

Referring to FIGS. 2B and 9, the inner end of top wall 150 of the plug member has transversely spaced cutaway portions or slots 162 therein defining a central projection 164 which is bent perpendicularly downwardly from the top wall to form an end wall 166 and then is bent outwardly to form a lug 168 parallel to the top wall 150. As shown in FIG. 2B, the end surface of lug 168 lies in the plane of the end surfaces of legs 158.

Referring to FIGS. 2B and 3B, lug 168 is received by one end of coiled compression spring L′. The other end of the compression spring receives a lug 170 on control member K′, the lug projecting downwardly and then longitudinally outwardly from inner edge 172 of slot 136 in the control member. The compression spring acts between end wall 166 of the plug member and edge 172 of slot 136 of the control member to urge the control member and plug member away from each other. The spring thus biases the inner end surface 128 (FIG. 2B) of the control member into engagement with the respective lug 130 on camming plate N of the control lever and also causes a transverse down-turned lug 174 (FIG. 3B) which depends from the outer end of top wall 150 of the plug member to be biased into engagement with inclined camming surfaces 176 which are provided by the outer edge of each of the side walls 114 and 116 of hook member H′ (FIG. 13).

Left-hand latch mechanism B is substantially identical to right-hand latch mechanism B′, just described, the only difference being the addition of combination locking means E (FIGS. 2B and 3B) cooperable with control member K of latch mechanism B. The fact that control lever D is located to the right of center of the luggage case requires that control member K be made slightly longer than control member K′ to accommodate the greater distance between latch mechanism B and the control lever. Moreover, control member K has a large rectangular opening 180 therein (FIGS. 2A and 2B) to provide clearance for the combination locking means.

Referring to FIGS. 2B and 3B, the combination locking means comprises a pair of upstanding brackets P, a frame Q, a shaft R, dials S having associated sleeve means T, a bolt member W, a shift lever X, and coiled compression springs Y and Z (FIG. 2B).

Figure 6:
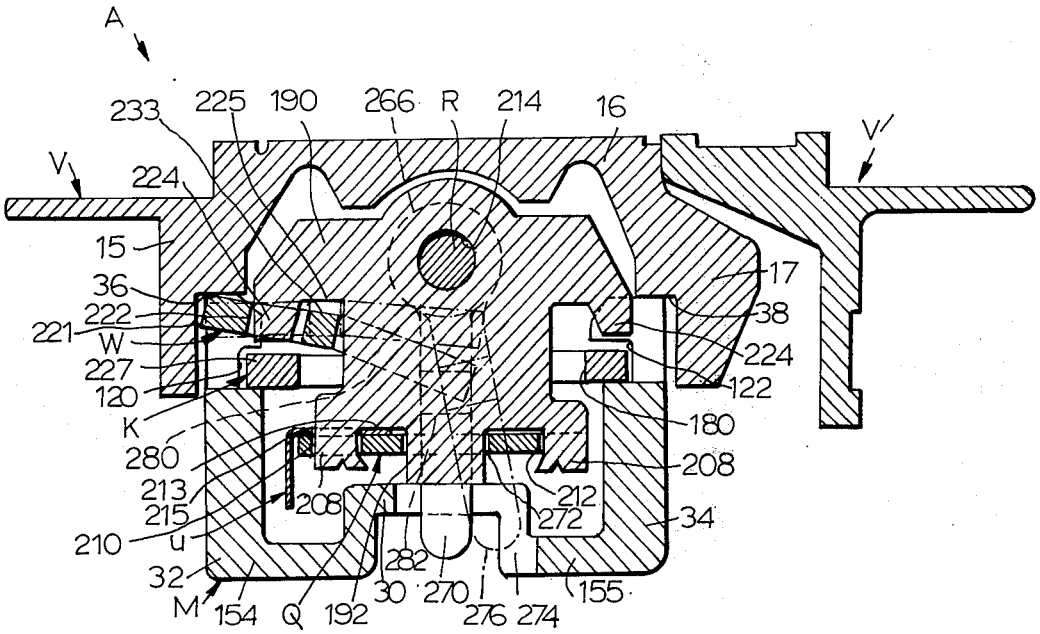
FIG. 6 is an enlarged, transverse cross-sectional view taken approximately in the plane of line 6—6 of FIG. 3B.
Figure 11:
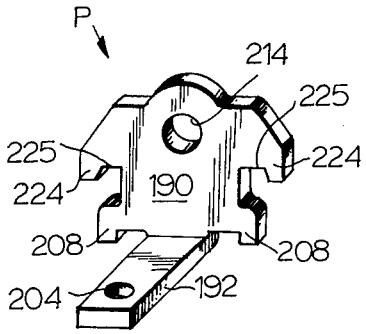
FIG. 11 is a perspective view of one of a pair of brackets employed in the latching device.
Figure 12:
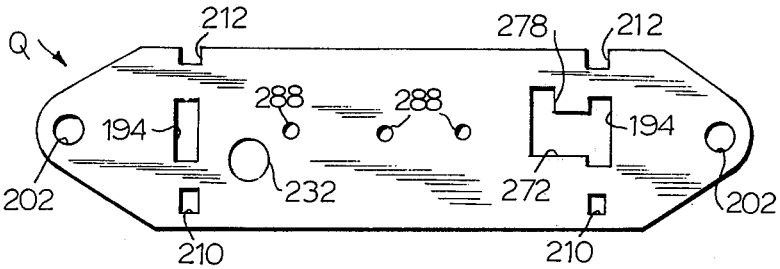
FIG. 12 is a top plan view of a frame employed in the latching device.

Referring to FIGS. 3B and 11, each bracket P has an upstanding planar wall 190 and a mounting lug 192 which projects downwardly a short distance from the bottom edge of the wall before bending outwardly perpendicular to the wall. As shown in FIG. 3B, connecting lugs 192 of the pair of longitudinally spaced brackets P are received through respective rectangular openings 194 in frame Q (FIG. 12) and extend longitudinally away from each other between the frame and the raised central bottom wall portion 30 of channel member M. The frame and the brackets are secured to the channel member by a pair of headed-over rivets 200 which are received through holes 202 in the frame (FIG. 12), holes 204 at the ends of the connecting lugs 192 of the brackets (FIG. 11) and respective holes 206 in bottom wall portion 30 of the channel member (FIG. 3B). Referring to FIG. 6, lugs 208 project downwardly from opposite ends of the bottom edge of wall 190 through associated openings 210 and notches 212 in frame Q (FIG. 12) and are staked over to reinforce walls 190 in vertical position.

Figure 14:
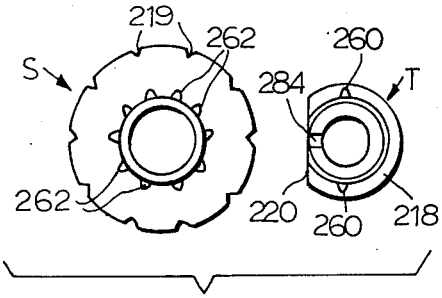
FIG. 14 is a side elevational view of one of the combination dials and associated sleeve means employed in the latching device.

As shown in FIG. 3B, longitudinally extending shaft R has its ends slidably received in corresponding openings 214 (FIG. 11) in the brackets. A plurality of rotatable combination dials S (FIG. 14) having numbers on the outer periphery thereof are keyed for rotation with their associated sleeve means T (FIG. 14) on the shaft, the dials projecting partially through respective slots 216 (FIG. 1) in the raised central top wall portion 16 of valance member V. As known in the combination lock art, and as shown in FIGS. 3B and 14, each sleeve means T provides a flange 218 and a flat portion 220.

Figure 5:
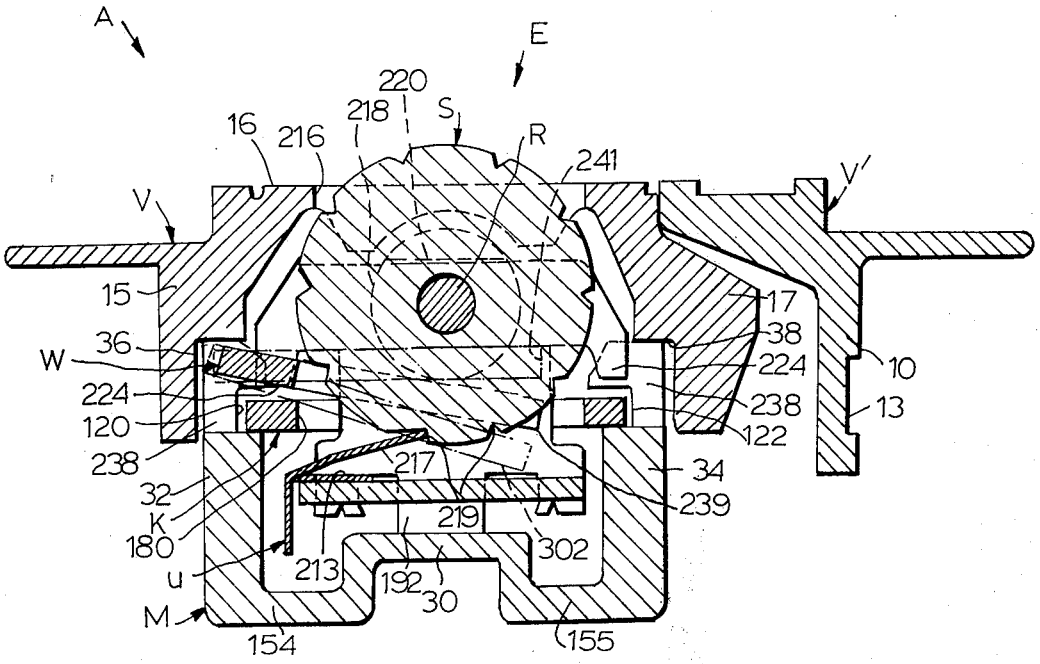
FIG. 5 is an enlarged, transverse cross-sectional view taken approximately in the plane of line 5—5 of FIG. 3B.
Figure 15:
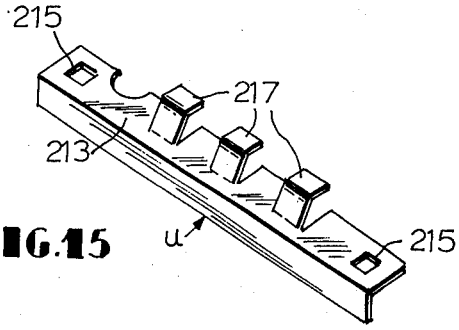
FIG. 15 is a perspective view of a dial spring employed in the latching device.

The longitudinally extending planar portion 213 of dial cooperable indexing spring U (FIG. 15) is secured against frame Q by the bottom edges of brackets P, as shown in FIG. 6, this portion of the indexing spring having openings 215 which receive a lug 208 of each bracket. Three spring fingers 217 are cooperable with notches 219 (FIG. 14) in the outer peripheries of respective dials to releasably maintain the dials in the selected circumferential positions, as shown in FIG. 5.

Figure 10:
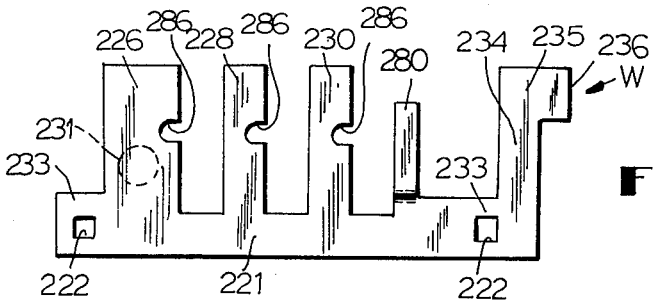
FIG. 10 is a top plan view of a bolt employed in the latching device.

Referring to FIGS. 2B and 3B, bolt member W is supported for pivotal movement beneath sleeve means T by brackets P. Specifically, and as shown in FIG. 2B, the bolt member (FIG. 10) includes a longitudinally extending portion 221 having rectangular openings 222 near opposite ends thereof each loosely receiving the corresponding one of a pair of transversely spaced lugs 224 (FIG. 11) which project downwardly from downwardly-facing shoulders 225 on both sides of each bracket. As shown in FIG. 6, the clearance between control member K and the ends of lugs 224 is less than the thickness of the bolt member. Thus, the thin longitudinal portion 227 of the control member which lies below the longitudinal portion 221 of the bolt member and adjacent slot 180 prevents openings 222 of the bolt member from moving out of their loose engagement with lugs 224, thereby providing pivotal support for the bolt member. Referring to FIGS. 2B and 10, projecting from portion 221 of the bolt member are longitudinally spaced fingers 226, 228 and 230 which extend transversely adjacent respective dials (FIGS. 2B and 3B) for cooperation with their associated sleeve means, finger 226 having greater longitudinal width than either of fingers 228 and 230. These fingers are biased into engagement with the sleeve means by coiled compression spring Z (FIG. 2B) which acts between frame Q and finger 226 to pivot the bolt member away from the frame. A short, downwardly projecting, cylindrical lug 231 on finger 226 (FIG. 10) and an upstanding cylindrical lug 232 on the frame (FIG. 12) are received by opposite ends of spring Z to maintain the spring in the position shown in FIG. 2B. Spring Z also tends to urge the thin, longitudinal portions 233 (FIG. 10) of the bolt member which lie adjacent openings 222 into engagement with the corresponding shoulders 225 on brackets P, as shown in FIG. 6.

The bolt member W is further provided with an additional transversely pprojecting finger 234 (FIG. 10) which extends closely adjacent to the innermost bracket P on the side which faces puller D, as shown in FIG. 2B. The end portion of finger 234 is extended longitudinally at 235 to provide a transversely oriented stop surface 236 which is cooperable with a transverse abutment surface 237 (FIG. 2B) on control member K to control movement of the control member in a manner to be described. As shown in FIGS. 2B and 5, side walls 32 and 34 of the channel member are each cut away at 238 to provide clearance for the bolt member and lugs 224 of the brackets.

Operation of the latching device of the invention will now be described. Referring to FIGS. 2A and 2B, compression springs L and L′ urge plug members J and J′, respectively, outwardly into engagement with the hook members H and H′ on their associated latch members G and G′. The springs also urge the control members K and K′ inwardly to bias their inner end surfaces 128 into engagement with respective lugs 130 on camming plate N of control lever D. Lugs 174 at the outer ends of the plug members, being biased into contact with the sloping camming surfaces 176 on side walls 114 and 116 of the associated hook members (FIG. 3B), tend to urge the latch members from the lowered position of FIG. 3B toward the raised position shown in FIG. 4B. However, when control lever D is in the solid line position of FIG. 1 so that the control members K and K′ are in the positions shown in FIGS. 2A, 2B, 3A and 3B, the downwardly facing surfaces 142 (FIGS. 3A and 3B) at the ends of tongues 138 on the control members are engaged by the upwardly facing surfaces 144 on the side walls 114 and 116 of the hook members, thereby preventing springs L and L′ from moving the latch members to raised position. Referring to FIGS. 2A, 2B and 7, when the latch members are in lowered position, each of plug members J and J′ is positioned longitudinally such that one of the legs 152 which is nearest the female valance member V′ engages the hooked portion 240 of the associated one of hasps C and C′, thereby latching the luggage case sections together.

Referring to FIG. 3B, when the dials are off combination, flange 218 of one or more of the sleeve means T engage the associated fingers 226, 228 and 230 on plug member W, thereby holding the plug member in the angular position designated 239 in FIG. 5. With the bolt member in this position, stop surface 236 of the bolt member is in longitudinal alignment with surface 237 on the control member K for blocking outward (i.e.,leftward) movement of the control member from the position shown in FIG. 3B. Control lever D, which is urged into the normal solid line position of FIG. 2 by the engagement of end surfaces 128 of inwardly biased control members K and K′ with their associated lugs 130 on camming plate N, is therefore prevented from being manually rotated counterclockwise to the dotted line position of FIG. 1. Thus, rightward movement of control member K′ from the position shown in FIGS. 2B and 3B by means of the control lever is also blocked. Consequently, end surfaces 142 on tongues 138 of the control members K and K′ cannot be disengaged from surfaces 144 on the hook members H and H′, respectively, so that the latch members G and G′ and their associated plug members J and J′ remain locked in the latching positions shown in FIGS. 2A, 2B, 3A and 3B.

When the dials S have been rotated to the predetermined opening combination (i.e., when the dials are on combination), the flat portions 220 of sleeve means T are all aligned to face bolt member W, as shown in FIG. 4B. Spring Z (FIG. 2B), acting between frame Q and finger 226 on the bolt member, biases fingers 226, 228 and 230 of the bolt member into engagement with the flat portions of the sleeve means, so that the plug member is pivoted from the blocking position of FIG. 3B (position 239 of FIG. 5) to the unblocking position of FIG. 4B (position 241 of FIG. 5). In such position, stop surface 236 on finger 234 is removed from longitudinal alignment with surface 238 on control member K. Control lever D may then be manually rotated (by thumb pressure, for example) approximately 45° from the solid line position of FIG. 1 to the dotted line position of FIG. 1, the down-turned lugs 130 on the camming plate N during this motion acting against end surfaces 128 of the control members K and K′ to move the control members outwardly away from the control lever. When the control members reach the positions shown in FIGS. 4A and 4B, surfaces 142 on tongues 138 at the ends of the control members move out of engagement with surfaces 144 on side walls 114 and 116 of hook members H and H′. This permits coiled compression springs L and L′, which have been further compressed due to the outward movement of the control members, to move the plug members J and J′ outwardly from the latching positions of FIGS. 3A and 3B to the unlatching positions shown in FIGS. 4A and 4B, in which legs 152 of the plug members are disengaged from hooked portions 240 of the hasps. During this movement, the down-turned lugs 174 at the outer ends of the plug members are cooperable with camming surfaces 176 on side walls 114 and 116 of hook members H and H′ to pivot the latch members G and G′ upwardly from the lowered positions of FIGS. 3A and 3B. Outwardly projecting lugs 110 at the ends of the hook members thus snap into engagement with stop surfaces 112 on plates F and F′, thereby limiting upward rotation of the latch members by the springs to the raised positions shown in FIGS. 4A and 4B, which limits outward movement of the plug members to the positions shown.

Coiled compression springs L and L′ continue to act between the plug members J and J′ and their associated control members K and K′ to bias the inner end surfaces 128 of the control members into engagement with lugs 130 on camming plate N of the control lever. As a result, when the manual pressure applied to rotate control lever D to the dotted-line position of FIG. 1 is thereafter released, the compression springs shift the control members inwardly toward each other to the positions shown in FIGS. 3A and 3B, thereby returning the control lever to the solid line position of FIG. 1. The latch members and the plug members remain in the unlatching positions shown in FIG. 4B. With the latch mechanisms B and B′ thus set to unlatching condition, the hooked portions 240 of the hasps may be removed from slots 242 (see FIGS. 2A and 2B) in the side wall 34 of channel member M (FIG. 7) to permit opening of the luggage case.

To close the luggage case, it is necessary that the latch mechanisms be in unlatching condition so that the slots 242 are not blocked by legs 152 of the plug members, as would be the case if the latch mechanisms were in the latching condition shown in FIGS. 3A and 3B. With the hasps received in the notches, downward manual pressure is applied to both latch members, preferably simultaneously by the palms of both hands, to move the latch members from raised to lowered position against the force of springs L and L'. During this movement, camming surfaces 176 provided by side walls 114 and 116 of the latch members cooperate with down-turned lugs 174 on the plug members to move the plug members toward the latching positions shown in FIGS. 3A and 3B and into engagement with the hooked portions 240 of the hasps. Referring to FIGS. 2A, 2B and 9, the inner edges of legs 152 of the plug members are beveled at 246 so that the hasp-engaging leg 152 on each plug member makes substantially parallel contact with the engageable surface 248 on hooked portion 240 of the respective hasp, providing a camming action for drawing together the luggage case sections. Referring to FIGS. 4A and 4B, as the latch members are moved toward lowered position, camming surfaces 250, which are provided by the inner edges of side walls 114 and 116 (FIG. 13) of the hook members and which slope in the opposite sense from camming surfaces 176, are brought into engagement with the curved top surface of tongues 138 at the end of the control members, which assumed the positions shown in FIGS. 3A and 3B after the control lever D was released. These surfaces cooperate to move the control members outwardly away from each other as the latch members are moved toward the lowered position shown in FIGS. 3A and 3B until camming surfaces 250 are moved downwardly out of engagement with tongues 138. At this time, coil springs L and L' snap the control members inwardly toward each other and into engagement with respective lugs 130 on camming plate N of control lever D, this movement of the control member also bringing surfaces 142 of the tongues 138 into engagement with surfaces 144 of the hook members, thereby securing the latch members G and G' in lowered position so that the latch mechanisms B and B' are held in latching condition, as shown in FIGS. 2A, 2B, 3A and 3B.

It will be apparent that the construction of the latching device of the invention permits the latch mechanisms to be conveniently changed from unlatching to latching condition by downward pressure applied to the latch members by the palms of the hands, even when both hands are employed to hold the luggage case sections together. Furthermore, considerable force can be applied to the latch members so that the plug members can cooperate with the hasps to draw the luggage case sections together, which may be necessary if the luggage case is overpacked.

It is within the scope of the invention to provide the combination locking means E with an opening combination which is preset at the factory and is intended to be used only with such combination. For this kind of lock, the sleeve means T may be formed integrally with their associated dials S. In the preferred and illustrated embodiment of the invention, however, the lock is constructed so that one may change or set the opening combination to a combination of one's own personal choice. For this purpose, the sleeve means T and dials S are made as separate parts, and as will subsequently be described, the sleeves and dials are constructed to be separably keyed to each other.

In greater detail and as illustrated in FIG. 14, each sleeve means T has a pair of diametrically opposed teeth 260 which are receivable by notches 262 in its associated dial S. Referring to FIG. 4B, the sleeve means are biased into abutting end-to-end relation against an annular flange 264 at one end of shaft R by a coiled compression spring Y which acts against the leftmost bracket P. Shift lever X has a tubular portion 266 rotatably mounted on the shaft between annular flange 264 and the rightmost bracket P, the flange acting to bias the tubular portion of the shift lever against that bracket under the action of spring Y. A shift lever arm 270 extends from tubular portion 266 through the longitudinal portion of an L-shaped opening 272 in frame Q (this opening communicating with slot 194 of the frame, as shown in FIG. 13) and through a slot 274 in the raised bottom wall portion 30 of channel member M, as shown in FIG. 6. When the dials are on combination, shift lever arm 270 may be manually engaged to move the shift lever leftwardly against the force of spring Y, thereby disengaging teeth 260 of the sleeve means (FIG. 14) from notches 262 of their associated dials (FIG. 14). After the shift lever has been moved longitudinally to such an extent, it is rotated from the solid line position of FIG. 6 to the dotted line position designated 276 so that the lever arm 270 is received by the transverse portion of opening 272 of the frame. The shift lever arm is thereafter released, being held in engagement with edge 278 (FIG. 12) of the opening by the force of coil spring Y. The dials S may then be rotated relative to their associated sleeve means to establish a new opening combination, the sleeve means being held in the circumferential positions of FIG. 4B by the cooperation of fingers 226, 228 and 230 of the bolt member with the flat portions 220 of the sleeve means. Once the dials have been turned to the new opening combination, the shift lever X is returned to the position shown in FIG. 4B to key the dials and sleeve means together in their new relative circumferential positions. The combination locking means is then ready for use with the new combination.

To prevent unkeying the sleeve means from their associated dials by the shift lever when the dials are not on combination, bolt member W is provided with an additional finger 280 (FIG. 10) which projects transversely from portion 221 of the bolt member at a small downward angle relative to the plane of that portion and the other fingers, as shown in FIG. 6. When the dials are off combination, the bolt member is in the position shown in FIGS. 3B (and in solid and dashed lines in FIG. 6) so that finger 280 is longitudinally aligned with and adjacent to the end of an axially extending lug 282 on shift lever arm 270, thereby blocking leftward movement of the shift lever. However, when the dials are on combination, the bolt member is in the position shown in FIG. 4B (and shown in phantom in FIG. 6) so that lug 280 is out of blocking relation with respect to lug 282 on the shift lever, thereby enabling the shift lever to be moved leftwardly to unkey the sleeve means from their respective dials in the manner described above.

The combination locking means as illustrated further includes means for finding the opening combination in the event that the combination has been lost or forgotten when the bottom of the latching device is still accessible. Referring to FIG. 4B, each of the sleeve means T (FIG. 14) is provided with an indicator or slot 284 which may be viewed or felt through aligned notches 286 and holes 288 and 290 in bolt member W (FIG. 10), frame Q (FIG. 12) and channel member M when the sleeve means are moved into the positions shown in FIG. 4B.

The construction of the latching device of the invention also provides means for unlocking the latching device in the event that the opening combination is lost or forgotten when the bottom of the latching device is not accessible, such as when the latching device is employed on a luggage case which is locked closed. Referring to FIG. 1, in male valance member V the right transverse edge of slot 216 for the center dial has a notch 300 at one end thereof. This notch, which may be about 0.01 inch by 0.125 inch, enables the user or a repairman to insert a narrow spring steel blade therethrough to contact finger 230 of the bolt member. Sufficient downward pressure on the blade forces the bolt to pivot downwardly to the position designated 302 in FIG. 5, in which blocking surface 236 (FIGS. 2B and 3B) on finger 234 of the bolt member is moved downwardly out of blocking relation with abutment surface 237 on control member K. Actuating the control lever D while holding the bolt member in this position will move the control members outwardly away from each other to release the latch mechanism to unlatching condition. After the luggage case has been opened, the lost combination can be determined by locating indicators 284, as described above.

It is believed that the advantages and improved results furnished by the latching device of the invention will be apparent from the foregoing description of a preferred embodiment thereof. Various changes and modifications may be made without departing from the spirit and scope of the invention, as sought to be defined in the following claims.

We claim:

1. A latching device cooperable with a pair of spaced hasps comprising a pair of spaced latch members having lowered and raised positions for latching and unlatching conditions, respectively, biasing means for urging the latch members into raised position, a manually operable actuating member movable to latching and release positions, longitudinally movable engagement means associated with the actuating member, the engagement means being engageable with respective latch members for holding the latch members in lowered position when the actuating member is in the latching position and being movable out of engagement with the latch members when the actuating member is moved into the release position, thereby enabling the latch members to be moved to raised position by the biasing means, and a longitudinally movable plug member associated with each latch member for engaging a hasp when the latch member is in lowered position, the plug member being disengaged from the hasp when the latch member is in raised position.

2. A latching device as set forth in claim 1, further comprising combination locking means cooperable with the engagement means for releasably locking the latch mechanisms in latching condition.

3. A lathcing device as set forth in claim 2, wherein the combination locking means includes a plurality of rotatable dials, sleeve means associated with each dial and providing a flange and a flat portion, and a bolt member cooperable with the sleeve means, the bolt member being supported for pivotal movement between a blocking position for preventing disengagement of the engagement means from the latch members when the dials are off combination and an unblocking position for permitting disengagement of the engagement means from the latch members when the dials are on combination.

4. A latching device as set forth in claim 1, wherein the engagement means comprises a pair of control members extending between the acutating member and respective latch members, the control members being longitudinally movable in opposite directions by respective camming surfaces provided by the actuating member.

5. A latching device as set forth in claim 4, wherein the biasing means also urges the control members into engagement with the respective camming surfaces.

6. A latching device as set forth in claim 4, wherein the biasing means comprises spring means for urging the plug members out of engagement with their respective hasps, each plug member and its associated latch member having means providing camming surfaces which cooperate to urge the latch member toward raised position.

7. A latching device as set forth in claim 6, wherein the means providing camming surfaces on each latch member comprises hook means extending from the latch member, the hook means having an additional surface engageable by means provided at the end of the respective control member for maintaining the latch member and the plug member in latching condition.

8. A latching device as set forth in claim 6, wherein the spring means also urges the control members into engagement with the respective camming surfaces provided by the hook means, the spring means comprising a pair of coiled compression springs acting between respective plug members and their associated control members.

9. A latching device as set forth in claim 4, further comprising combination locking means for releasably locking the latch members in latching position, the combination locking means including a plurality of rotatable dials, sleeve means associated with each dial and providing a flange and a flat portion, and blocking means cooperable with the sleeve means, the blocking means being in blocking position for preventing disengagement of the control members from the latch members when the dials are off combination and being in unblocking position for permitting disengagement of the control members from the latch members when the dials are on combination.

10. A latching device as set forth in claim 9, wherein the blocking means in the blocking position is cooperable with means provided by only one of the control members for blocking movement of both control members.

11. A latching device as set forth in claim 9, wherein the blocking means is a bolt member supported for pivotal movement between the blocking and unblocking positions, wherein the dials extend through respective slots for manual engagement, and wherein one of the slots is shaped to receive means for pivoting the bolt member to an additional unblocking position different from the first-mentioned unblocking position.

12. A latching device as set forth in claim 9, wherein the combination locking means further comprises means for enabling the opening combination to be changed.

13. A latching device as set forth in claim 1, wherein the actuating member comprises a rotatable control lever and the longitudinally movable engagement means comprises a pair of control members extending between the control lever and the respective latch members, the control members being longitudinally movable in opposite directions by respective camming surfaces provided by the control lever; and wherein the latching device further comprises combination locking means, the combination locking means including a bolt member for blocking movement of the control lever from the latching position when the combination locking means is off combination and for permitting the control lever to be moved from latching position to release position when the combination locking means is on combination.

14. A latching device as set forth in claim 13, wherein the bolt member is supported for pivotal movement between a blocking position and an unblocking position, the bolt member in the blocking position being engageable with a stop surface provided by one of the control members for blocking outward movement of both control members by the control lever; and wherein the combination locking means further comprises a plurality of rotatable dials and sleeve means associated with each dial and providing a flange and a flat portion, the sleeve means being cooperable with means provided by the bolt member for holding the bolt member in the blocking position when the dials are off combination and for holding the bolt member in the unblocking position when the dials are on combination.

15. A latching device as set forth in claim 13, wherein the control lever has a cam plate fixed thereto cooperable with respective inner end surfaces of the control members.

* * * * *